US005103723A

United States Patent [19]

Maier

[11] Patent Number: 5,103,723

[45] Date of Patent: Apr. 14, 1992

[54] INKING UNIT FOR GRAVURE PRINTING PRESS

[75] Inventor: Peter Maier, Worms, Fed. Rep. of Germany

[73] Assignee: Albert-Frankenthal Aktiengesellschaft, Fed. Rep. of Germany

[21] Appl. No.: 756,914

[22] Filed: Sep. 9, 1991

[30] Foreign Application Priority Data

Sep. 26, 1990 [DE] Fed. Rep. of Germany ..... 4030377

[51] Int. Cl.[5] ..... B41F 9/06; B41F 31/06; B41F 31/36; B41L 27/08

[52] U.S. Cl. ..... 101/153; 101/351

[58] Field of Search ..... 101/150, 153, 160, 161, 101/350, 363, 349, 351, 352, 207, 208, 210; 118/258, 259

[56] References Cited

U.S. PATENT DOCUMENTS

| | | | |
|---|---|---|---|
| 2,974,586 | 3/1961 | Hunt | 101/169 X |
| 4,354,449 | 10/1982 | Zink | 101/169 |
| 4,815,377 | 3/1989 | Shiera | 101/352 |

FOREIGN PATENT DOCUMENTS

| | | |
|---|---|---|
| 248463 | 3/1911 | Fed. Rep. of Germany . |
| 1282026 | 8/1966 | Fed. Rep. of Germany . |
| 1611286 | 4/1970 | Fed. Rep. of Germany . |
| 7229629 | 11/1972 | Fed. Rep. of Germany . |
| 259684 | 7/1925 | United Kingdom . |

*Primary Examiner*—J. Reed Fisher

*Attorney, Agent, or Firm*—Jones, Tullar & Cooper

[57] ABSTRACT

An inking unit for a gravure printing press has an ink trough which is movable vertically with respect to a forme cylinder which contacts ink in the trough. An inking roller is supported by levers in the ink trough and is shiftable with respect to the trough to control the impression pressure between the inking roller and the forme cylinder which it contacts.

8 Claims, 2 Drawing Sheets

INKING UNIT FOR GRAVURE PRINTING PRESS

Field of the Invention

The present invention is directed generally to an inking unit for a gravure printing press. More particularly, the present invention is directed to an inking unit for a rotogravure printing press in which the contact pressure of the inking roller with the forme cylinder can be maintained at a constant level. Most specifically, the present invention is directed to an inking unit for a rotogravure printing press in which the contact pressure between the forme cylinder and the inking roller and the immersion depth of the forme cylinder can be maintained constant with differing diameter forme cylinders. The inking unit of the present invention utilizes a vertically adjustable ink trough which, in turn, supports an inking roller on support arms which are pivotable to move the inking roller in the trough. This allows constant ink roller to forme cylinder pressure to be maintained even if the size of the forme cylinder is changed.

Description of the Prior Art

Gravure inking units are generally known in the art. In these prior devices, such as the one shown in German patent specification No. 248463, there is provided an inking roller which transports ink on the forme cylinder of the gravure printing unit.

In the German utility model No. 72296 29 there is shown an assembly in which the level of an ink trough, in respect to a forme cylinder, can be adjusted. In this prior device, the trough is supported by spaced threaded rods which are turned through pinion gears from a central drive source. In this prior art device, there is not shown the use of an inking roller to transport the ink on the gravure-forme cylinder.

The prior art devices do not allow the contact pressure between the inking roller and the forme cylinder to be easily adjusted or controlled. Further, the prior art devices do not provide for the expeditious adjustment of the position of the ink trough so that the inking unit can be used with forme cylinders having various diameters. Thus there is a need for an inking unit that is usable with a gravure printing press which will allow such adjustments to be made. The inking unit in accordance with the present invention provides such an assembly and is a significant improvement over the prior art devices.

Summary of the Invention

It is an object of the present invention to provide an inking unit for a gravure printing press.

Another object of the present invention is to provide an inking unit with an inking roller.

A further object of the present invention is to provide an inking unit having means to maintain a preselected immersion depth of the forme cylinder.

Yet another object of the present invention is to provide an inking unit with an inking roller in which the contact pressure of the inking roller with the forme cylinder may be held constant.

Still a further object of the present invention is to provide an inking unit in which the impression pressure of the inking roller on the forme cylinder and the immersion depth of the forme cylinder into the gravure ink can be maintained constant even with forme cylinders having various diameters.

As will be set forth in detail in the description of the preferred embodiment which is presented subsequently, the inking unit for a gravure printing press in accordance with the present invention includes an inking trough that is supported for vertical movement with respect to the forme cylinder that is partially immersed in the ink carried in the inking trough. If forme cylinders having differing diameters are used, the inking trough can be shifted vertically to maintain a preselected immersion depth of the forme cylinder in the ink. The ink trough also carries an inking roller which is held in contact against the surface of the forme cylinder. This inking roller is supported by spaced pivot levers. At least one of these pivot levers is attached to a piston and cylinder assembly. This allows the pivot lever to be pivoted about an intermediate pivot axis so that the pressure of the inking roller against the forme cylinder can be maintained at a desired level. This further allows the inking roller to be shifted as is required when various sized forme cylinders are utilized.

A principal advantage of the inking unit in accordance with the present invention resides in its ability to maintain this constant impression pressure of the inking roller at the forme cylinder. The impression pressure can be adjusted and maintained constant even when the size of the forme cylinder with which the inking roller is cooperating varies substantially. For example, a constant impression pressure can be maintained even when the diameter of one forme cylinder is twice that of another forme cylinder. Within the operating size range of the inking unit in accordance with the present invention, the immersion depth of the forme cylinder in the ink trough can be made uniform while maintaining a constant impression pressure of the inking roller against the forme cylinder. The depth of immersion thus does not change the impression pressure. In addition, this impression pressure can be selectively modified without having to change the immersion depth of the forme cylinder in the ink.

It will thus be seen that the inking unit for a gravure printing press in accordance with the present invention overcomes the limitations of the prior art devices and is a substantial advance in the art.

Brief Description of the Drawings

While the novel features of the inking unit for a gravure printing press in accordance with the present invention are set forth with particularity in the appended claims, a full and complete understanding of the invention may be had by referring to the detailed description of the preferred embodiment which is presented subsequently, and as illustrated in the accompanying drawings in which:

Detailed Description of the Preferred Embodiment

Figure 1:
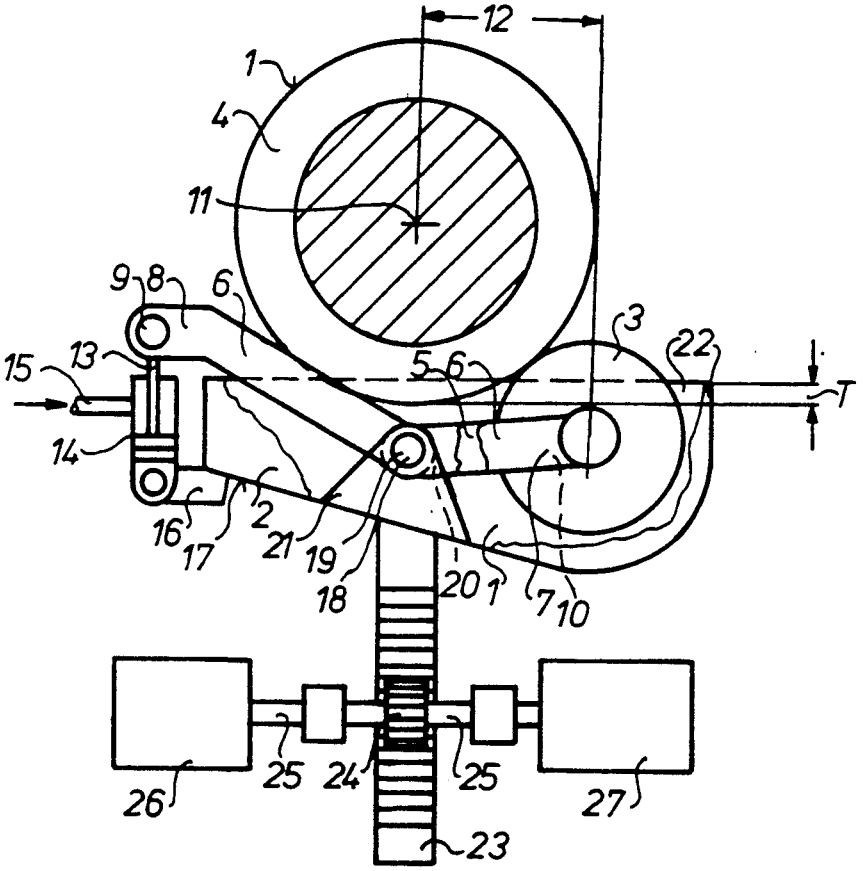
FIG. 1 is a schematic side elevation view of a preferred embodiment of an inking unit for a gravure printing press in accordance with the present invention and showing the unit with a small diameter forme cylinder.

Referring initially to FIG. 1, there may be seen an inking unit for a gravure printing press in accordance with the present invention. An inking trough, generally at 2 has a sloped bottom surface 17 and spaced side walls 22. These form a reservoir that holds a suitable quantity of a generally known gravure ink 1. An inking roller 3 is supported within the inking trough 2 and is partially immersed in the gravure ink 1. This inking roller 3 may be provided with a suitable textile envelope or covering and is immersed, typically to a depth of generally about 5/6 of its diameter into the ink 1. This inking roller 3 does not have its own drive means.

A forme cylinder 4 is also immersed to a selected immersion depth T, which is typically in the range of a few centimeters, in the ink 1 in the ink trough 2. The forme cylinder 4 is in rolling contact with the inking roller 3 and the inking roller 3 is caused to rotate by its contact with the forme cylinder 4. The immersion depth of the inking roller 3 is to some extent dependent on the diameter of the forme cylinder. A comparison of FIG. 1, which shows the use of a small diameter forme cylinder 4, with FIG. 2, which shows the use of a large diameter forme cylinder 4, shows the variation in immersion depth of the inking roller 3 in response to variations in the diameter of the forme cylinder 4.

Figure 2:
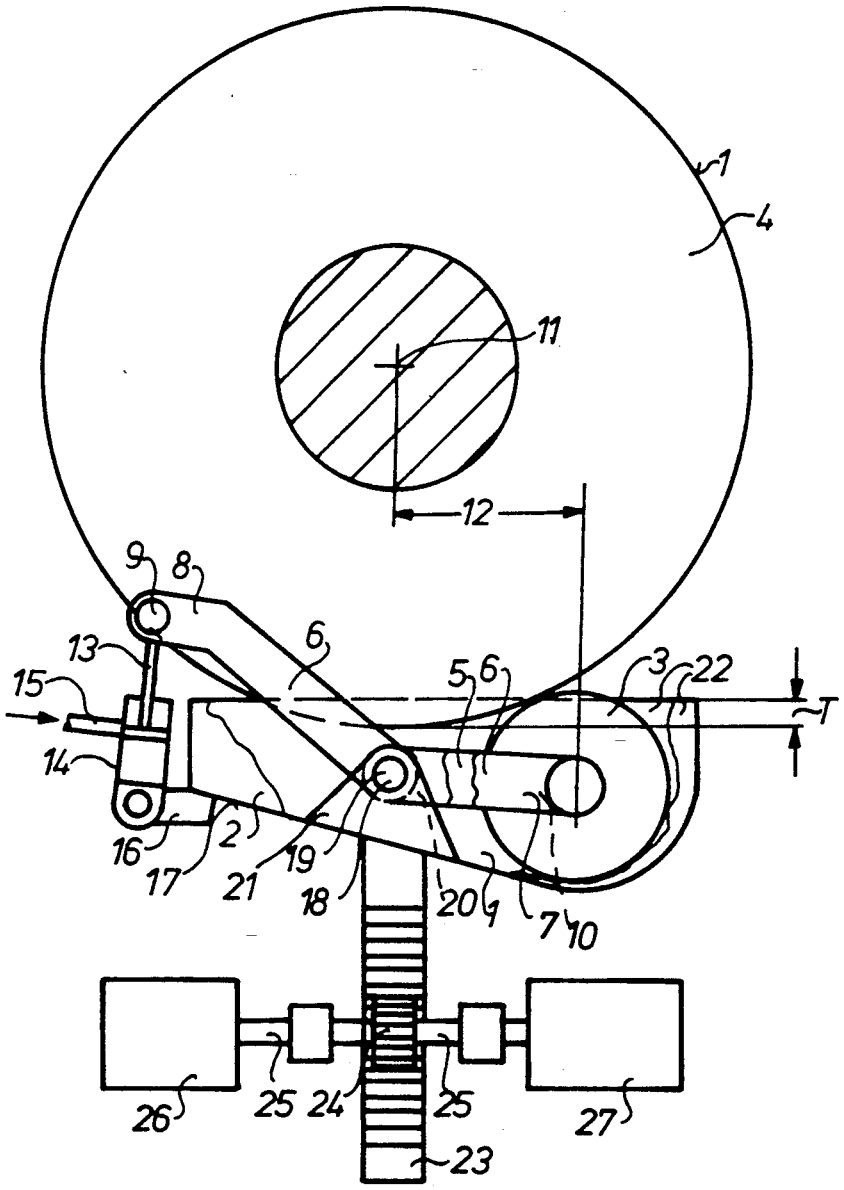
FIG. 2 is a schematic side elevation view generally similar to that shown in FIG. 1 and showing the unit with a large diameter forme cylinder.

As may be seen in FIGS. 1 and 2, the inking roller 3 is supported in the ink trough 2 generally on the right side of the forme cylinder at a distance 12 between a vertical plane through the axis of rotation 11 of the forme cylinder 4 and the center of rotation of the inking roller 3. As mentioned previously, the inking roller 3 is in frictional contact with the surface of the forme roller 4. The inking roller 3 is rotatably supported between the first end 10 of a single arm lever 5 and the first end 7 of a double arm lever 6. The double arm lever 6 is generally elbow-shaped, as may be seen in FIGS. 1 and 2. A second end 8 of the double arm lever 6 extends to the left beyond the end of the ink trough 2.

A first end of a piston rod 13, which is carried by a single acting cylinder 14, is connected to the second end 8 of the double arm lever 6 through a rotatable journal assembly, generally at 9. The second end 8 of the double armed lever 6 may be provided with a forked or split portion which supports the journal assembly 9. The single acting cylinder 14 may be supplied with a suitable fluid under pressure through a supply tube 15. This pressurized fluid supplied to cylinder 14 may be either hydraulic or pneumatic. The pressure of the fluid supplied through line 15 to cylinder 14 from any suitable supply source, such as a compressor or a pump, may be controlled by any suitable hand operated valve, automatic pressure controller or the like. The bottom of cylinder 14 is attached through a suitable thrust bearing to a support bracket 16. This support bracket 16 is, in turn, welded or otherwise secured to the bottom plate 17 of the ink trough 2.

Referring again to FIGS. 1 and 2, a central, curved portion 18 of the double armed lever 6 is provided with a bore. The second end 20 of the single arm lever 5 is provided with a similar bore. These two bores receive spaced ends of a spindle 19 which is welded to the lever arms 5 and 6 so that they are rigidly interconnected. Opposite ends of the spindle 19 are rotatably supported in aligned apertures in two spaced spindle support pieces 21, with one each of these spindle support pieces 21 being securely attached to the bottom plate 17 of the ink trough 2 adjacent the spaced trough side walls 22 and inside of the ink trough 2.

The inking roller 3, which is rotatably supported between the first ends 10 and 7 of the single and double arm levers 5 and 6, respectively, is also shiftable generally vertically with respect to the bottom plate 17 of the ink trough 2. A supply of pressurized fluid to the cylinder 14 through the supply line 15 or the removal of fluid from the cylinder 14 will cause the piston rod 13 to move with respect to the cylinder. This movement will, in turn, cause the second end 8 of the double lever arm 6 to move generally vertically. Since double lever arm 6 is pivotably supported at its elbow or curved portion 18 by the spindle 19, a downward movement of the second end 8 of the double arm lever 6 will result in an upward movement of the first ends 7 and 10 of the double and single arm levers 6 and 5. This motion of these levers will cause a corresponding movement of the inking roller 3. In a similar manner, an upward movement of the second end 8 of the double arm lever 6 will result in a downward movement of the inking roller 3. Thus the impression force between the inking roller 3 and the forme cylinder 4 can be controlled by the control of the fluid pressure to the cylinder 14.

The bottom plate 17 of the ink trough 2 is rigidly and securely attached to an upper end of a pinion shaft 23. As may be seen in FIGS. 1 and 2, the upper end of the pinion shaft 23 is attached to the outer surface of bottom plate 17 generally in the center of the plate 17. The pinion shaft 23 is slidably but non-rotatably supported by a suitable sleeve or bushing which is not specifically shown. Thus the pinion shaft 23 can move vertically but will not be able to rotate. A pinion gear 24 is in gear mesh engagement with the gear teeth of the pinion shaft 23. The pinion gear 24 is secured to a drive shaft 25 through a gear with a back gear ratio to a stepper motion 26 and to a counter 27. The counter 27 acts to provide an indication of the height of the ink trough 2 by counting the revolutions of the stepper motor 26. The height of the ink trough 2 at any particular instance is usable to provide a measure of the immersion depth of the forme cylinder 4 in the ink trough 2. By running the stepper motor 26 and hence causing the drive shaft 25 and the pinion gear 24 to rotate, the ink trough 2 can be raised or lowered to regulate the immersion depth of the forme cylinder 4 in the ink carried in the ink trough 2 independently of the diameter of the forme cylinder 4.

As was discussed above, the position of the inking roller 3 can also be varied by use of the pressure cylinder 14. This will allow the impression force of the inking roller 3 on the forme cylinder 4 to be properly and accurately set independently of the diameter of the forme cylinder 4. Suitable pressure sensing means can be used to measure the pressure between the inking roller 3 and the forme cylinder 4, as well as the pressure of the fluid supplied to the cylinder 14.

While a preferred embodiment of an inking unit for a gravure printing press in accordance with the present invention has been set forth fully and completely hereinabove, it will be apparent to one of skill in the art that a number of changes in, for example, the sizes of the inking roller and the forme cylinder, the type of pressure medium used on the cylinder, the type of stepper motor used, and the like, may be made without departing from the true spirit and scope of the present invention, which is accordingly to be limited only by the following claims.

What is claimed is:

1. An inking unit for a gravure printing press having a forme cylinder, said inking unit comprising:

an ink trough having a bottom plate and side walls;

means for raising and lowering said ink trough with respect to the forme cylinder;

an inking roller supported in said ink trough and being engageable with the forme cylinder;

a single arm lever and a double arm lever, each of said levers having a first end, said inking roller being rotatably supported between said first ends of said single and double arm levers;

a fluid pressure actuated cylinder attached to said ink trough and being in operative contact with a second end of said double arm lever; and means rotatably supporting a second end of said single arm lever and an intermediate portion of said double arm lever with respect to said ink trough.

2. The inking unit for a gravure printing press in accordance with claim 1 wherein said cylinder is operated by a pressurized gaseous medium.

3. The inking unit for a gravure printing press in accordance with claim 1 wherein said cylinder is operated by a pressurized liquid medium.

4. The inking unit for a gravure printing press in accordance with claim 1 wherein said means for raising and lowering said ink trough includes a pinion shaft and a driven pinion gear.

5. The inking unit for a gravure printing unit in accordance with claim 4 wherein said driven pinion gear is supported on a drive shaft which is driven by a stepper motor.

6. The inking unit for a gravure printing press in accordance with claim 5 further including a counter attached to said drive shaft and usable to indicate a position of said ink trough.

7. The inking unit for a gravure printing press in accordance with claim 1 wherein said double arm lever is generally elbow-shaped.

8. The inking unit for a gravure printing press in accordance with claim 1 wherein said second end of said single arm lever and said intermediate portion of said double arm lever are rotatably supported in spaced brackets secured to said bottom plate of said ink trough.

* * * * *